US006433890B1

(12) United States Patent
Beckett et al.

(10) Patent No.: US 6,433,890 B1
(45) Date of Patent: Aug. 13, 2002

(54) SYSTEM AND METHOD FOR IMPROVING PRINTING OF A LEADING EDGE OF AN IMAGE IN A GRAVURE PRINTING PROCESS

(75) Inventors: Tony D. Beckett; Kenneth William Jackson, both of Dayton, OH (US)

(73) Assignee: MDC Max Daetwyler AG (CH)

( * ) Notice: Subject to any disclaimer, the term of this patent is extended or adjusted under 35 U.S.C. 154(b) by 0 days.

(21) Appl. No.: 09/159,926

(22) Filed: Sep. 24, 1998

(51) Int. Cl.[7] ..... B41C 1/02

(52) U.S. Cl. ..... 358/1.9; 358/3.29; 358/3.3; 358/3.31; 347/18

(58) Field of Search ..... 358/1.9, 299; 101/150, 101/157; 347/18, 5, 6, 17

(56) References Cited

U.S. PATENT DOCUMENTS

| | | | | |
|---|---|---|---|---|
| 2,112,010 | A | | 3/1938 | Brimberg |
| 2,160,951 | A | | 6/1939 | Alice |
| 2,164,209 | A | | 6/1939 | Howey et al. |
| 2,441,651 | A | | 5/1948 | Thompson |
| RE23,914 | E | | 12/1954 | Boyajean |
| 2,925,464 | A | | 2/1960 | Raible |
| 3,280,252 | A | | 10/1966 | Lilien et al. |
| 3,612,753 | A | | 10/1971 | Korman |
| 3,636,251 | A | | 1/1972 | Daly et al. |
| 3,641,932 | A | * | 2/1972 | Behringer ..... 101/157 |
| 3,652,992 | A | | 3/1972 | Koll |
| 3,769,455 | A | | 10/1973 | de Vos et al. |
| 3,770,888 | A | | 11/1973 | de Vos et al. |
| 3,784,739 | A | | 1/1974 | de Vos et al. |
| 3,904,816 | A | | 9/1975 | Taudt et al. |
| 3,956,583 | A | | 5/1976 | Pugsley |
| 3,983,319 | A | | 9/1976 | Moe et al. |
| 4,003,311 | A | | 1/1977 | Bardin |
| 4,007,362 | A | | 2/1977 | Sindermann |
| 4,079,235 | A | | 3/1978 | Froyd et al. |
| 4,115,816 | A | | 9/1978 | Moe et al. |
| 4,174,527 | A | | 11/1979 | Schaefer |
| 4,189,752 | A | | 2/1980 | Moe et al. |
| 4,245,260 | A | | 1/1981 | Doelves |
| 4,259,697 | A | | 3/1981 | Doelves |
| 4,287,537 | A | | 9/1981 | Pfau et al. |
| 4,347,785 | A | | 9/1982 | Chase et al. |
| 4,357,633 | A | | 11/1982 | Buechler |
| 4,363,037 | A | | 12/1982 | Taudt |
| 4,394,693 | A | | 7/1983 | Shirley |
| 4,450,486 | A | | 5/1984 | Buechler |
| 4,451,856 | A | | 5/1984 | Buechler |

(List continued on next page.)

FOREIGN PATENT DOCUMENTS

| | | |
|---|---|---|
| EP | 0 473 973 A1 | 3/1992 |
| RU | 931482 | 6/1982 |

OTHER PUBLICATIONS

"Twin–Pilot," Maschinenfabrik Kaspar Walter GmbH & Co., KG, Plinganserstrassee 22, 8000 Munchen 70, Germany, undated brochure.

(List continued on next page.)

*Primary Examiner*—Thomas D. Lee
(74) *Attorney, Agent, or Firm*—Jacox, Meckstroth & Jenkins

(57) ABSTRACT

This invention relates to a system and method for intelligently placing in a periodic and/or random manner a plurality of whetting areas which facilitate lubricating and/or cooling a doctor blade in a printing press when the cylinder is placed therein. The system and method includes one or more routines which analyzes engraving/etching data and any associated white-span length. One or more whetting areas are placed in a periodic or random pattern in response thereto. The whetting areas facilitate lubricating and/or cooling the doctor blade so that it does not heat beyond a predetermined level, thereby avoiding scoring of the cylinder and problems associated with deterioration of print quality or length of cylinder life resulting from thermodynamic expansion and/or undesired evaporation of ink associated with areas which make up the image.

42 Claims, 8 Drawing Sheets

U.S. PATENT DOCUMENTS

| | | | | | |
|---|---|---|---|---|---|
| 4,484,232 | A | | 11/1984 | Gast | |
| 4,500,929 | A | | 2/1985 | Buechler | |
| 4,510,511 | A | * | 4/1985 | Akutsu | 347/18 |
| 4,612,584 | A | | 9/1986 | George et al. | |
| 4,683,500 | A | | 7/1987 | Kitamura et al. | |
| 4,688,101 | A | | 8/1987 | Doelves et al. | |
| 5,027,513 | A | | 7/1991 | Allison, Jr. | |
| 5,329,215 | A | | 7/1994 | Fraser et al. | |
| 5,424,845 | A | | 6/1995 | Holowko et al. | |
| 5,438,422 | A | | 8/1995 | Holowko et al. | |
| 5,440,398 | A | | 8/1995 | Holowko et al. | |
| 5,481,366 | A | | 1/1996 | Sakamoto | |
| 5,485,662 | A | | 1/1996 | Hodges, Jr et al. | |
| 5,519,502 | A | | 5/1996 | Beckett | |
| 5,628,250 | A | | 5/1997 | Weisbrod | |
| 5,675,420 | A | | 10/1997 | Beckett | |
| 5,745,128 | A | | 4/1998 | Lam et al. | |
| 5,862,756 | A | | 1/1999 | Gorter | |

OTHER PUBLICATIONS

"Signal Processing Algorithms Using Fortran and C" by Samuel D. Sterns and Ruth A. David, Prentice Hall, Englewood Cliffs, New Jersey, 1993, p. 103.

"System Identification and Control Design Using P.I.M. + Software" by Ioan Dore Landau, Prentice Hall, Englewood Cliffs, New Jersey, 1990, p. 134.

"Computer Vision" by Dana H. Ballard and Christopher M. Brown, Prentice–Hall, Englewood Cliffs, New Jersey, 1982, Chapters 1 through 6.

"Automated Visual Inspection" by B. G. Batchelor, D. A. Hill and D. C. Hodgson, IFS (Publications) Ltd., UK and North–Holland (A Division of Elsevier Science Publishers BV), 1985, pp. 55–59, 81–83, 284–287, 290 and 291.

"Digital Picture Processing", Seocnd Edition, vol. 2, by Azreail Rosenfeld and Avinash C. Kak, Academic Press, Inc., Orlando, Florida, 1982, pp. 84–153.

"Image Processing Algorithms for Industrial Vision", by Gerlad J. Agin, SRI International, Feb. 9, 1979.

"Latest News for Engraving Maschine Manufactureres", presentation by Bruck–Service Goerz, Christian Stover, ERA Packaging Division Meting, Sep. 18 & 19, 1996.

"Lasterstream Update", Think Laboratory Japan, Gravure Cylinder Manufacture, Mar. 1995, Cooper and Turner Pty. Limited, Unit 1, 55–65 Grandview Street, Pymble NSW 2073, Australia.

"ADSP–2100 Family: Application Handbook vol. 1", Analog Devices, Inc. 1994, pp. 100–111.

"High Speed Electron Beam Engraving Method or Procedure for Engraving of Metal Cylidners", Wolfgang Boppel, c/o Dr. –Ing. Engineering R. Hell GmbH, Development Range or Scope Deep–Pressure Work or Plaant 2, Grenzstrasse 2, 2300 Kiel 14, Federal Republic of Germany, Optic 77 No. 2 (1987) 83–92 Copyright.

* cited by examiner

SYSTEM AND METHOD FOR IMPROVING PRINTING OF A LEADING EDGE OF AN IMAGE IN A GRAVURE PRINTING PROCESS

BACKGROUND OF THE INVENTION

1. Field of the Invention

This invention relates to a system and method for improving printing and, more particularly, to a system and method for providing a plurality of whetting areas on a workpiece for the purpose of cooling and/or lubricating a doctor blade of a printing press when the workpiece is used therein.

2. Description of the Related Art

During a gravure printing process, a workpiece, such as a cylinder, is situated in the press with a portion thereof submerged in ink. As the cylinder rotates, areas on the cylinder receive ink and transmit the ink to a substrate, such as paper, plastic, film and the like in a manner conventionally known.

The press typically had a doctor blade which engaged a surface of the workpiece and wiped the excess ink off the surface, so that ink within the areas would be transmitted to the substrate.

Typically, the workpiece would be engraved with a plurality of areas which collectively correspond to one or more images. Unfortunately, when there were significant spans between adjacent areas along a circumferential direction, then the doctor blade began to heat to undesired levels, such as in excess of 200 degrees Fahrenheit. One problem with the doctor blade heating is that when it first encountered the ink associated with an image edge of the engraved image area which defined the image to be printed, the doctor blade would be so hot that it would cause the ink along such image edge to evaporate.

Another problem with the doctor blade heating beyond a desired level is that it would begin to scratch the surface of the cylinder as the blade undergoes a thermo-dynamic expansion.

In the past, microcracks in the surface of the cylinder facilitated lubricating and cooling the doctor blade. Oftentimes, however, the microcracks were not deep enough to hold an appreciable amount of ink or did not provide enough lubrication to lubricate and/or cool the doctor blade. A workpiece which has very little engraved or etched area, will need more lubrication and, consequently, require more and deeper microcracks. Likewise, a cylinder which has a large portion of its surface area engraved or etched, requires less and shallower microcracks because the engraved or etched portion facilitates lubricating and/or cooling the doctor blade as it preforms its function.

In the past, small non-printing cells known as "scum dots" were placed on the surface in response to a visual inspection of the cylinder in an attempt to overcome this problem. This empirical approach oftentimes resulted in too few or too many dots being situated on the cylinder, resulting in a doctor blade which was either not lubricated enough or lubricated to much.

Unfortunately, the processes heretofore known could not be selectively turned up or down to suit a cylinders specific lubrication needs. Furthermore, a leading edge of an engraved or etched area oftentimes does not print correctly. Because the doctor blade removes or causes some of the ink at the leading edge to be removed or evaporated. Surface tension and adhesion of the ink within an engraved or etched area to the walls defining the engraved or etched area is also thought to be a cause of poor printing quality.

What is needed, therefore, is a system and method for evaluating data and strategically positioning an appropriate number of whetting areas to facilitate eliminating or reducing the aforementioned problems.

SUMMARY OF THE INVENTION

It is, therefore, a primary object of the invention to provide a system and method for lubricating and/or cooling a doctor blade in a manner not previously known. Another object of the invention is to provide a system and method for strategically placing a plurality of whetting areas upstream of an engraved or etched image area, so that the resultant printing along a leading edge of an image associated with the engraved or etched area is improved.

In one aspect, this invention comprises a method for engraving/etching a plurality of whetting areas on a workpiece to facilitate lubricating and/or cooling a doctor blade when the workpiece is situated on a printing press, the method comprising the step of providing a system for engraving/etching a plurality of whetting areas at predetermined positions on the workpiece, the predetermined positions being determined in response to an image to be engraved or etched, a plurality of whetting areas being capable of holding ink for lubricating and/or cooling of the doctor blade when the workpiece is used in a printing press.

In another aspect, this invention comprises a method for locating a plurality of whetting areas on a workpiece to facilitate cooling and/or lubricating a doctor blade during a printing process, providing a whetting pattern determinor for determining a whetting pattern defining a plurality of whetting areas which facilitate cooling and/or lubricating the doctor blade in response to an image to be engraved or etched and providing a system for engraving/etching the whetting pattern and an image pattern corresponding to the image.

In still another aspect, this invention comprises a system for locating a plurality of whetting areas for facilitating cooling and/or lubricating a doctor blade on an printing press, comprising a whetting pattern determinor for determining a whetting pattern in response to an image to be engraved or etched, the whetting pattern determinor generating the whetting pattern of a plurality of whetting areas which facilitate cooling and/or lubricating the doctor blade in response to the image.

In yet another aspect, this invention comprises an engraving/etching system comprising a system for engraving/etching a workpiece with a plurality of areas defining an image pattern, a whetting pattern determinor for analyzing job data and for generating whetting data corresponding to a whetting pattern of whetting areas in response thereto and a signal generator for receiving the job data and the whetting data and for generating a signal in response thereto so that whetting pattern is engraved or etched relative to the engraved or-etched image pattern such that the whetting pattern facilitates cooling and/or lubricating a doctor blade in a printing press when the workpiece is used therein.

Other objects and advantages of the invention will be apparent from the following description, the accompanying drawings, and the appended claims.

BRIEF DESCRIPTION OF ACCOMPANYING DRAWINGS

DESCRIPTION OF THE PREFERRED EMBODIMENTS

Figure 1:
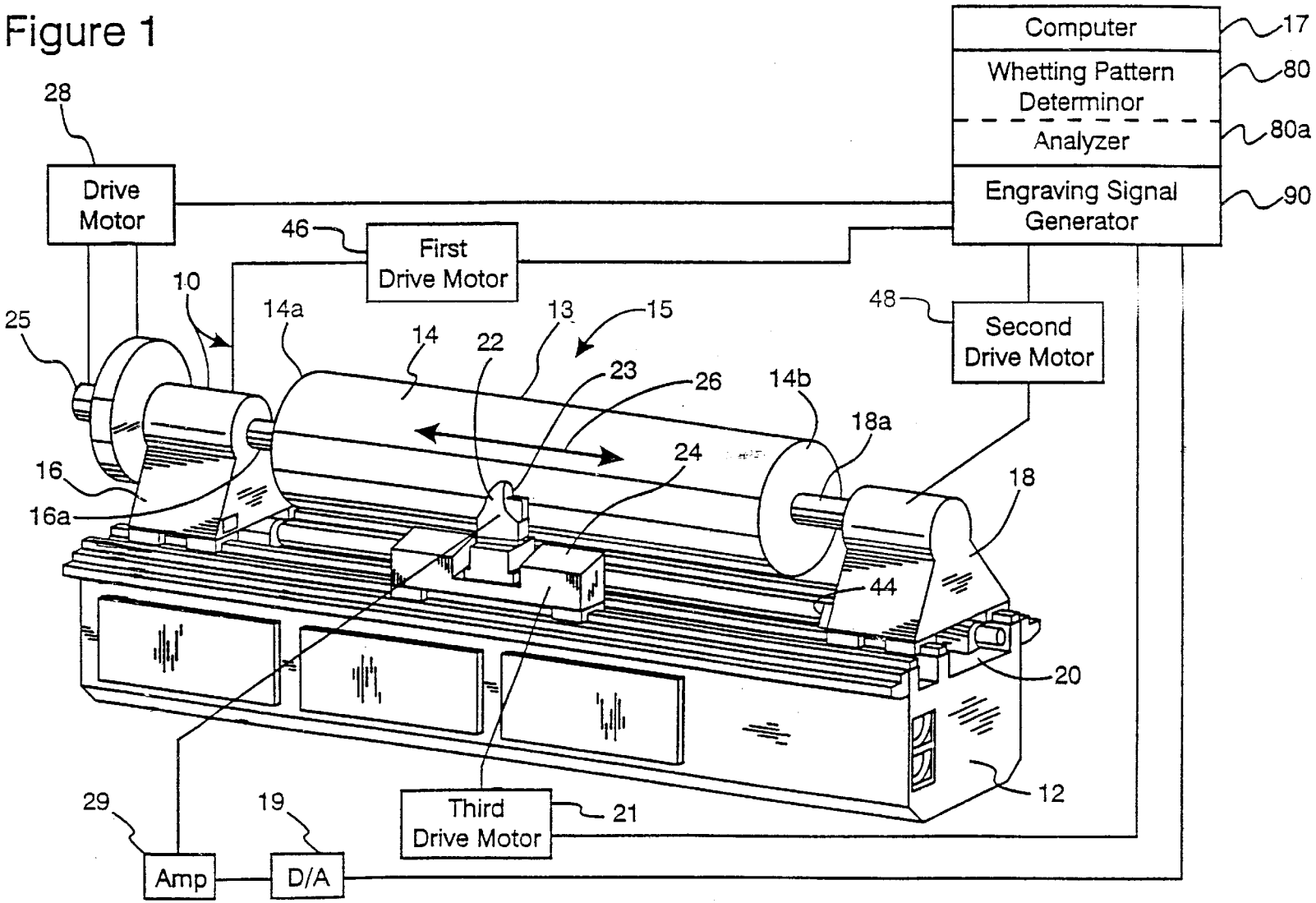
FIG. 1 is a general perspective view of an engraving/etching system in accordance with one embodiment of the invention.

FIG. 1 is a general perspective view of a preferred embodiment of a system which incorporates features of this invention. For ease of illustration, the invention is described for use on an engraving system, designated generally as engraver 10; however, it should be appreciated that the features of this invention may also be used in connection with other types of systems, such as laser engraving, laser etching or even chemical etching systems. In the embodiment being described, the engraver 10 is an electromechanical engraver, but the invention may be suitable for use in other engravers, such as a laser engraving or etching. The engraver 10 may have a surrounding, slidable safety cabinet structure which is not shown for ease of illustration.

Engraver 10 comprises a base 12 having a headstock 16 and a tailstock 18 slidably mounted in a track 20 such that the headstock 16 and tailstock 18 can move towards and away from each other. In this regard, engraver 10 comprises a plurality of linear actuators or first drive motor means or first drive motor 46 and a second drive motor means or second drive motor 48 which are capable of driving the headstock 16 and tailstock 18, respectively, towards and away form each other. For example, the drive motors may cause the headstock 16 and tailstock 18 to be actuated to a fully retracted position (not shown) or to a cylinder support position shown in FIG. 1.

The drive motors may be selectively energized to cause headstock 16 and tailstock 18 to be actuated either independently or simultaneously. Although not shown, a single drive motor may be used with a single leadscrew (not shown) having reverse threads on which either end causes the headstock 16 and tailstock 18 to move simultaneously towards and away from each other as the leadscrew is driven. Driving both headstock 16 and tailstock 18 permits cylinders 14 of varying lengths to be loaded by an overhead crane, for example, whose path is perpendicular to the axis of rotation of the cylinder 14. Although not shown, it should be appreciated that a stationary headstock 16 or tailstock 18 may be used with a driven headstock 16 or tailstock 18, respectively.

The headstock 16 and tailstock 18 comprise a first support cone or shaft 16*a* and a second support cone or shaft 18*a*, respectively. The support shaft 16*a* and 18*a* each comprise a conically shaped end which is suitable for engaging and rotatably supporting cylinder 14 at an engraving station 15 of engraver 10. In this regard, the cylinder 14 comprises a first end 14*a* and a second end 14*b*, each having a receiving opening for a receiving end, respectively. The receiving openings in ends 14*a* and 14*b* are conically shaped in cross-section so as to matingly receive the ends of cone 16*a* and 18*a*.

Although not shown, if a shafted cylinder (not shown) was to be engraved or etched, then headstock 16 and tailstock 18 would each include a gripping device or chuck (not shown) for receiving the shafts and also for rotatably supporting the cylinder 14 at the engraving station 15.

The engraver 10 also comprises an engraving head 22 having an engraving device, such as a cutting tool or stylus 23, for engraving a surface 13 of cylinder 14. In the embodiment being described, the engraving device 23 preferably has a diamond stylus; however, it should be appreciated that the invention may be used with other types of engraving devices, including, for example, laser engraving or etching devices.

The engraving head 22 is slidably mounted on a carriage 24 such that a third drive means or third drive motor 21 can drive the engraving head 22 towards and away from the surface 13 of cylinder 14 in a direction which is generally radial with respect to the rotational axis of cylinder 14. The carriage 24 is also slidably mounted on base 12 such that it traverses the entire surface 13 of cylinder 14 in the direction of double arrow 26 in FIG. 1, which is generally parallel to the axis of the cylinder 14. The engraver 10 also comprises a lead screw (not shown) and drive motors (not shown) for causing the carriage 24 to move in the direction of double arrow 26. The engraving head 22, carriage 24 and transverse movement thereof is similar to that shown in U.S. Pat. Nos. 5,438,422, 5,424,845 and 5,329,215 which are assigned to the same assignee as the present invention and which are incorporated herein by reference and made a part hereof.

The engraver 10 also comprises drive means or a drive motor 28 for rotatably driving the support member 16*a*, cylinder 14, and support member 18*a*. The drive motor 28 is also operatively coupled to the controlled 17, as shown.

The engraver 10 further comprises a programmable controller, processor or computer 17 which controls the operation of the engraver 10 and which also controls drive motors 21, 28, 46 and 48 mentioned earlier herein.

Although not shown, the engraver 10 may further comprise a support or support means for supporting the cylinder 14 between headstock 16 and tailstock 18, for example, during loading and unloading.

Computer 17 is also coupled to engraving head 22 and is capable of energizing engraving head 22 to engrave at least one controlled-depth area or cell as carriage 24 traverses surface 13 of cylinder 14 in a manner described later herein.

Figure 5:
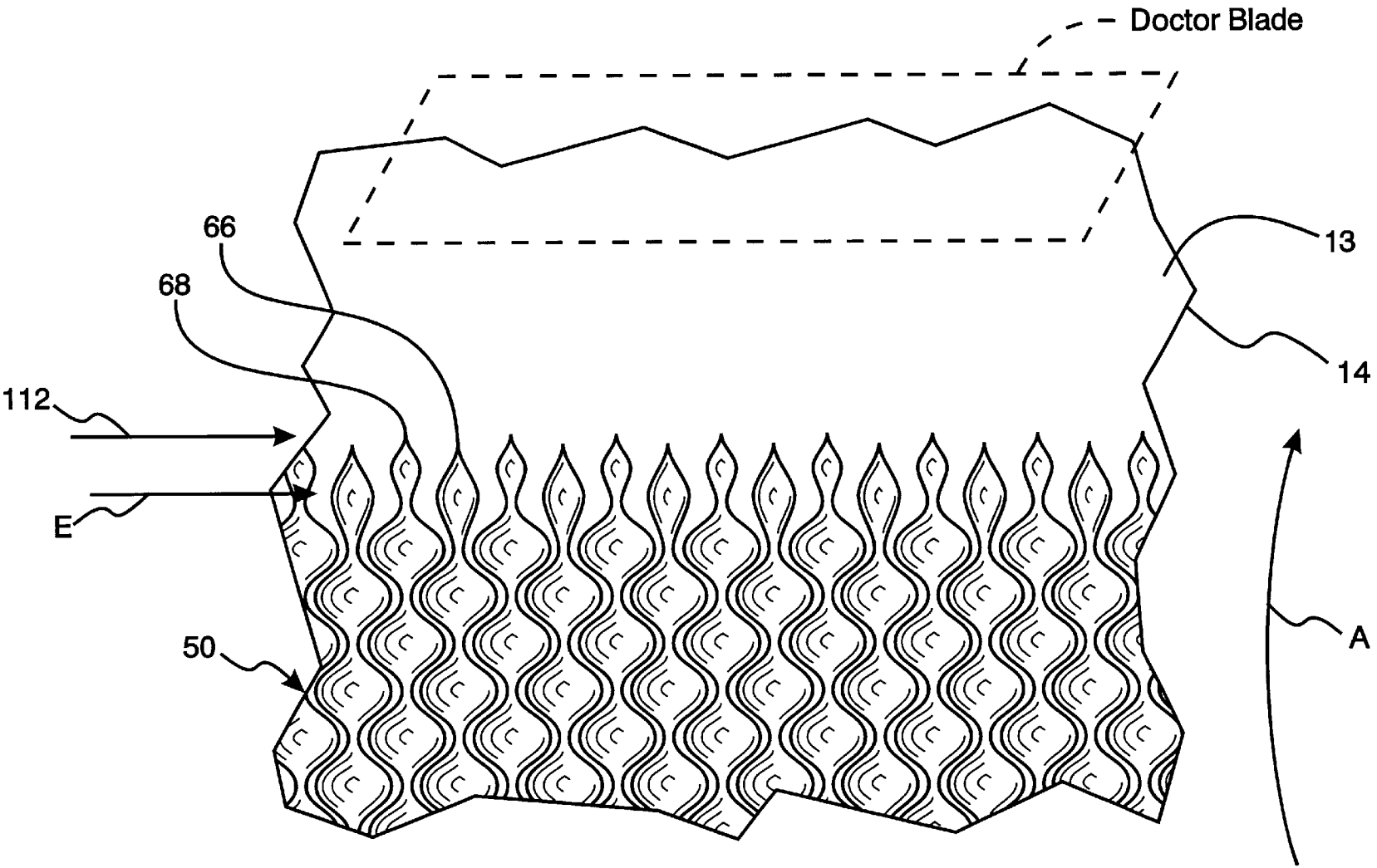
FIG. 5 is a general fragmentary view of a surface of a cylinder illustrating various whetting areas to facilitate lubricating and/or cooling a doctor blade.
Figure 6:
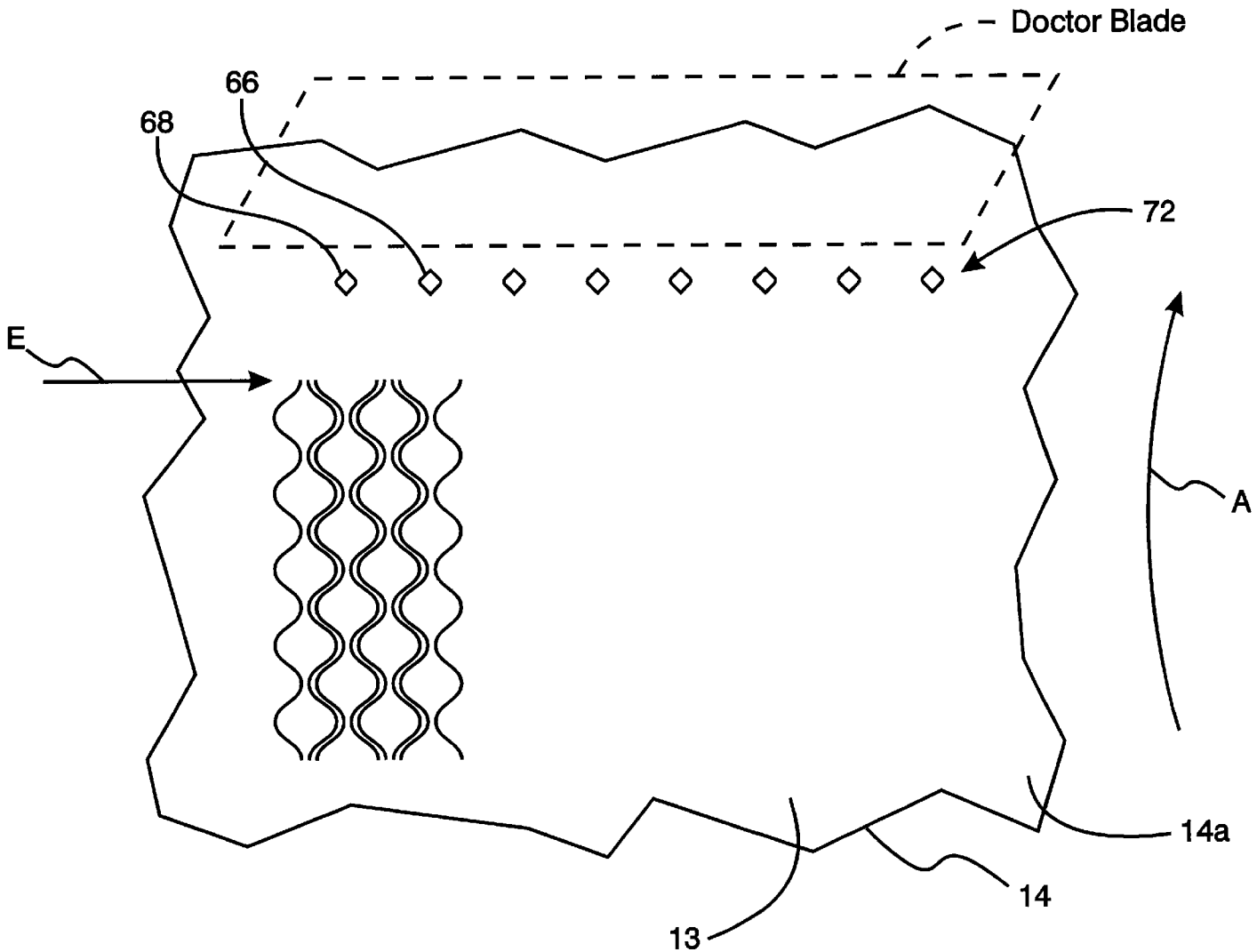
FIG. 6 is a fragmentary view of a surface of the cylinder showing a line of whetting areas.
Figure 7:
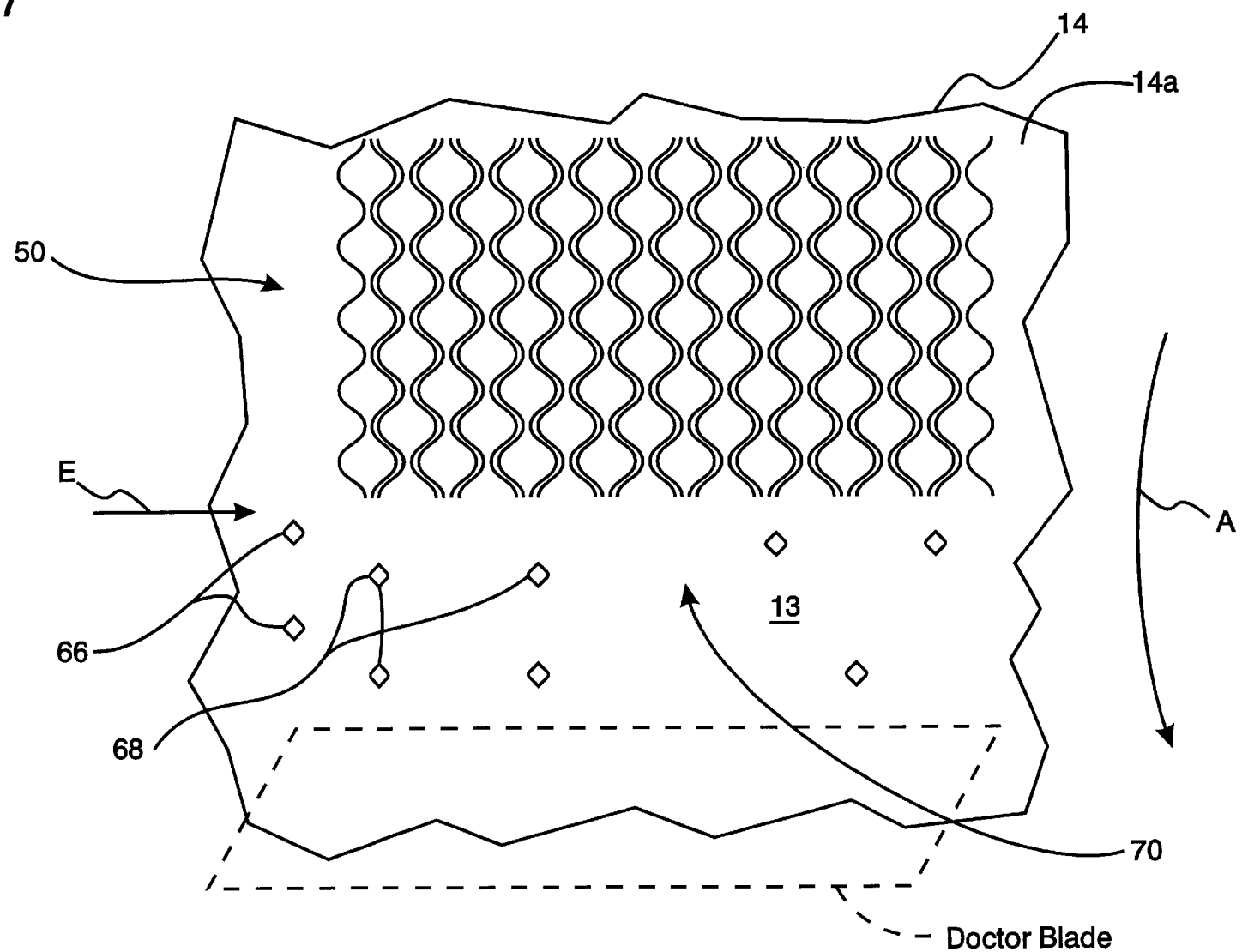
FIG. 7 is a fragmentary view of a surface of the cylinder showing a random pattern of whetting areas generated in accordance with features of this invention.

In accordance with an embodiment of the invention, an improved engraving/etching method and system is provided for providing a plurality of whetting areas or "scum" dots on surface 13 of cylinder 14 in response to an engraved etch job to facilitate lubricating and/or cooling of a doctor blade (as illustrated in FIGS. 5–7) in a printing press when the workpiece or cylinder 14 is used therein. Advantageously, this facilitates improving the printing performed by the press, particularly at the edges of the printing.

Figure 2:
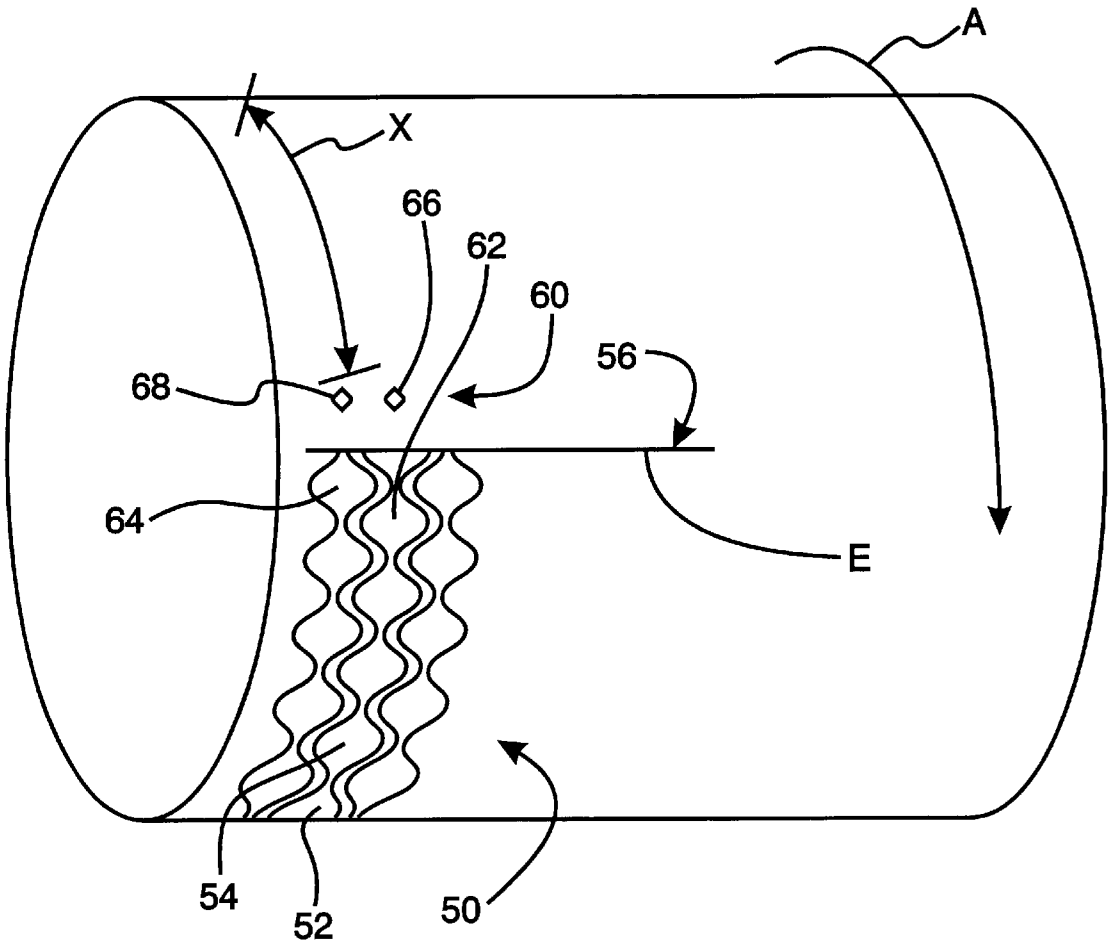
FIG. 2 is a perspective view of a cylinder engraved or etched in accordance with features of the present invention.

As illustrated in FIGS. 2 and 5–6, an engraved or etched pattern 50 comprises a plurality of areas, such as areas 52 and 54 on surface 13 of cylinder 14 (FIGS. 2 and 5–7). It should be appreciated that FIGS. 2 and 5–7 illustrate only a fragmentary portion of surface 13 of cylinder 14 and of the pattern 50. It should also be appreciated that during printing, cylinder 14 is rotated about its cylindrical axis to produce a surface motion or rotation indicated by arrow A in FIG. 2. Notice that a transition or edge area 56 is defined along line E in FIG. 2 which represents a transition between the pattern 50 and a non-engraved area 60. In general, the areas 52 and 54 are arranged in a series of nested columns, each having a plurality of lead cells or areas 62 and 64, respectively, which begin a plurality of vertical columns (as viewed in FIG. 2). It should be appreciated that these adjacent columns and cavities of areas are produced by oscillating the engraving/etching device or stylus 23 (FIG.1) into engraving/etching contact with surface 13 of cylinder 14 during rotation of cylinder 14.

As best illustrated in FIGS. 5–7, a feature of the present invention is that it is capable of placing one or more whetting areas, such as whetting areas 66 and 68, integrally adjacent to the engraved or etched image pattern 50 (as illustrated in FIG. 5) or immediately adjacent, but not integral (as illustrated in FIG. 6). As described later herein, the whetting areas may be generated by the system and method of the present invention in a periodic, non-random or uniform order. Alternatively and as shown in FIG. 7, the whetting areas may be placed in a non-periodic, random or non-uniform arrangement if desired. In any event, the whetting areas facilitate lubricating and/or cooling the doctor blade (FIGS. 5–7) when the cylinder 14 is used in a printing press (not shown).

In general, features of this invention are achieved by determining whether the whetting areas 66 and 68 need to be engraved in surface 13 of cylinder 14. In this regard, the system and method for generating the whetting areas utilizes job data which may be input from a remote computer (not shown), scanning device (not shown) or other suitable means which is ultimately stored on computer 17. The data is used to determine transitions between an engraved/etched area and a non-engraved/etched or white-span area for the purpose of determining whether a whetting pattern of whetting areas, such as pattern 70 shown in FIG. 7 and pattern 72 shown in FIG. 6. It should be appreciated that the job data may include image data corresponding to an image which represents both continuous tone image and/or linework image and the white-span data corresponding to non-engraved or white-span areas.

The engraving/etching data is typically stored in computer 17 (FIG. 1), and it provides a binary representation which indicates the area in which the continuous tone or linework data is to be placed. The job data relative to white-span areas along a cylindrical or helical track which are not engraved or etched is also stored as part of the job data. For each revolution of cylinder 14, a calculation of the non-engraved area for each cylindrical or helical track is determined in accordance with the routines described relative to FIGS. 3 and 4. In general, if a white-span (WHT.SPN.LENGTH) length or circumferential length of the white-span area is greater than a predetermined dimension, as described below, then the computer 17 causes a whetting pattern, such as patterns 70 (FIG. 7) or 72 (FIG. 6) or some combination thereof, to be engraved, chemically etched, or laser etched. The system and method for generating the whetting pattern, such as patterns 70 and/or 72, will now be described relative to FIGS. 1, 3 and 4.

Computer 17 comprises a whetting pattern determinor 80 (FIG. 1) comprising an analyzer 80*a* for receiving the job data comprising both image data associated with the image to be engraved or etched and data associated with white-span areas. Computer 17 further comprises a signal generator 90 for receiving the image data and whetting data from the whetting pattern determinor 80 and for generating an engraving/etching signal in response thereto. This facilitates ensuring the whetting pattern (such as pattern 70 or 72 in FIGS. 7 and 6, respectively) is engraved or etched relative to the engraved or etched image pattern 50 in order to facilitate cooling and/or lubricating the doctor blade (not shown) in a printing press (not shown) when the cylinder or workpiece 14 is used therein.

In the embodiment being described, the whetting pattern determinor 80 comprises a calculator or calculating means for calculating a white-span dimension in a given direction, such as a circumferential direction, an axial direction or a diagonal direction. The white-span dimension is then used by the whetting pattern determinor 80 to generate whetting data if the dimension exceeds a predetermined dimension. The whetting pattern determinor 80 analyzes the engraving/etching data and generates whetting data in accordance with the routines described in FIGS. 3 and 4 which will now be described.

Figure 3:
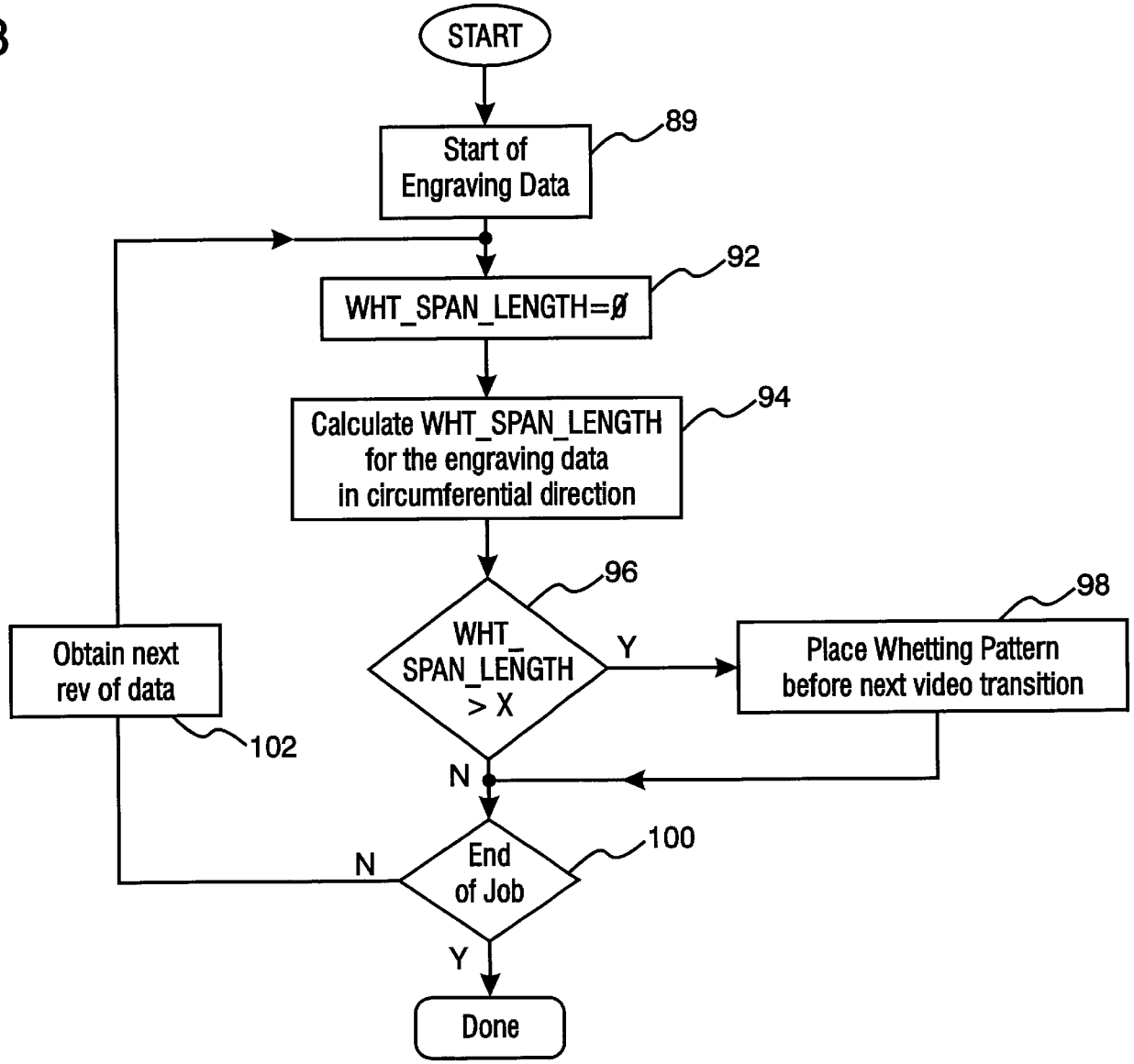
FIG. 3 is a schematic diagram of a transition based whetting pattern generator in accordance with one embodiment of the invention.

FIG. 3 discloses a transition based whetting pattern insertion routine resident on computer 17 which begins at block 89 with the start of the engraving/etching data. At block 92, a white-span length ("WHT.SPAN.LENGTH") is set in a buffer in computer 17 to zero. The analyzer 80*a* determines the white-span length using the engraving/etching data in a given direction, such as a circumferential direction as viewed in FIG. 2 (block 94).

At decision block 96, it is determined whether the calculated white-span length is greater than a predetermined length, such as a circumferential length, which is represented by the double arrow X in FIG. 2. If it is, then the routine places a whetting cell or engraved or etched area or a pattern of whetting areas before a transition to an image area, such as the transition (indicated by arrow E in FIG. 6). It should be appreciated that the white-span length in the embodiment being described corresponds to the number of consecutive areas with a zero percent video density value or, stated another way, the number of zero percent density value areas between transitions between images.

It should also be appreciated that the predetermined dimension in the embodiment being described corresponds to the minimum number of zero percent density value areas which require the placement of a whetting pattern, such as pattern 72 in FIG. 6, to facilitate maintaining the temperature of a doctor blade in a printing press below a predetermined or desired temperature. It should further be appreciated that the predetermined dimension may be determined in response to at least one of the following characteristics: copper hardness, rotational speed of the cylinder during printing, ink type, surface finish, roughness or smoothness, doctor blade type, blade pressure, or the general lack of a lubricating agent to lubricate the doctor blade. In general, any characteristic that would tend to cause the doctor blade to become heated beyond the desired temperature will cause the predetermined dimension to become shorter. The predetermined dimension may increase up to a point where the doctor blade achieves a temperature which requires cooling. By way of example, it has been found that when the doctor blade achieves temperatures in excess of 200 degrees fahrenheit it is desirable to engrave a whetting pattern in order to facilitate avoiding the problems associated with overheating the doctor blade.

Figure 8:
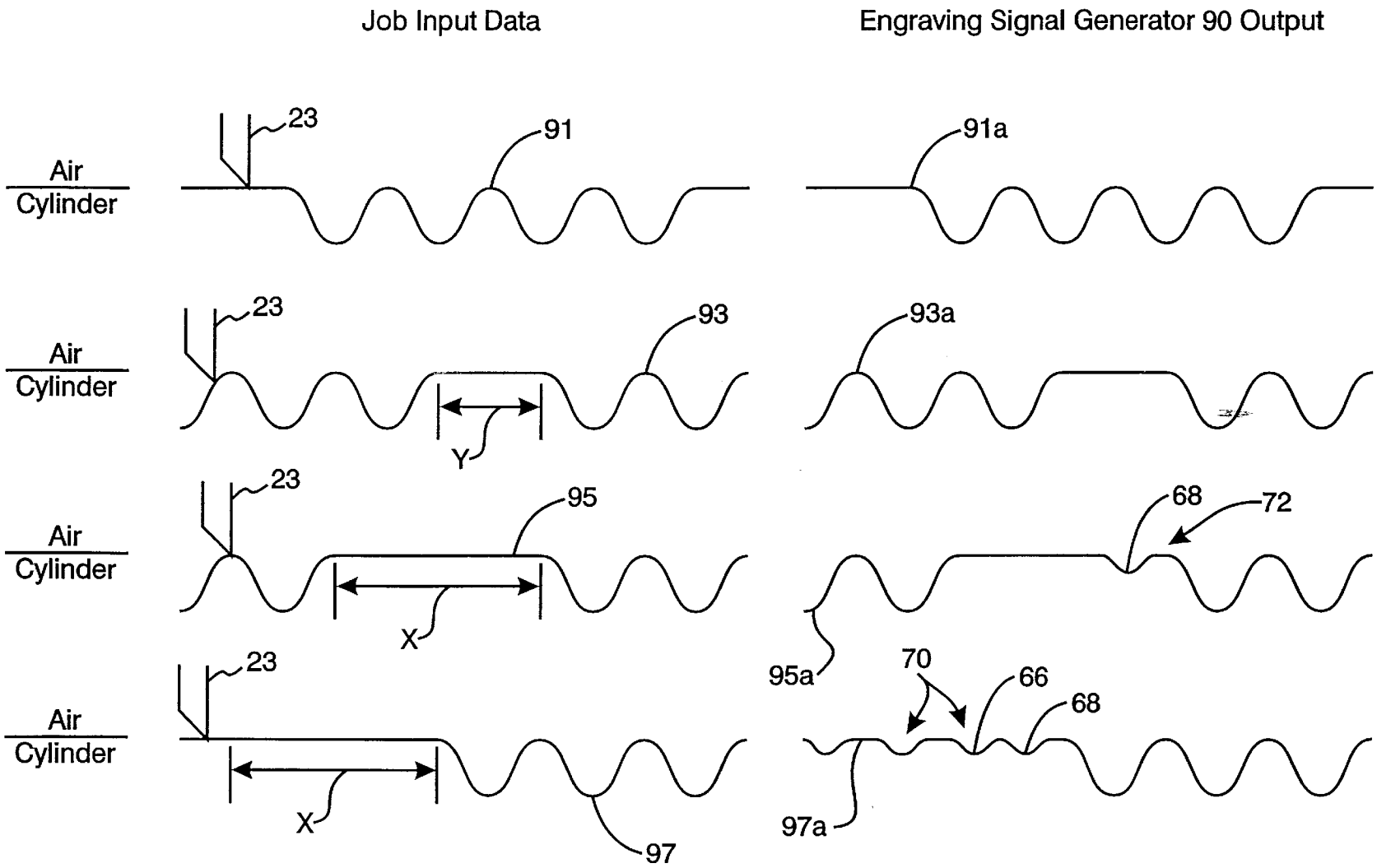
FIG. 8 is a view of a plurality of waveforms illustrating engraving/etching signals generated by engraving/etching signal generator 90 in response to engraving/etching data input represented in a sinusoidal waveform.

In the embodiment being described, the computer 17 generates a signal in response to the image data and whetting data which results in the whetting pattern being positioned as described. For ease of illustration, FIG. 8 illustrates an engraving/etching data input received by whetting pattern determinor 80 and which is used by the signal generator 90 to generate an engraving/etching signal in response to the image data and whetting pattern data. Notice, for example, that the engraving/etching data represented by the sinusoidal waveform 91 correlates to an image which does not have any appreciable white-span length greater than a distance X in FIG. 8. Accordingly, the engraving/etching signal generator 90 does not generate any whetting areas or pattern in response thereto as illustrated by the engraving/etching signal waveform 91*a*.

Likewise, signal 93 in FIG. 8, illustrates a white-span length (identified by arrow Y) which is not greater than the predetermined dimension X. Consequently, no whetting areas are generated by generator 90 in the ultimate corresponding engraving/etching signal output (93*a*).

Conversely, waveforms 95 and 97 illustrate engraving/etching data which has a white-span length which is greater than the predetermined dimension (identified by double arrow X in FIG. 8). In this example, whetting pattern determinor 80 and analyzer 80*a* cause the whetting pattern (e.g., patterns 70 and 72) to be generated. Engraving/etching signal generator 90 receives whetting data corresponding to the whetting pattern, as well as the image data, and ultimately generates engraving/etching signals 95*a* and 97*a*.

The signals 95*a* and 97*a* are received by engraving head 22 after being converted by D/A convertor 19 and amplified by amplifier 29. The head 22 engraves whetting areas (66 and 68 in FIGS. 5 and 6, for example) to define a pattern of whetting areas, such as pattern 70 relative to signal 97*a* or pattern 72 relative to signal 95*a*.

As mentioned previously herein, the whetting areas 66 and 68 may be placed randomly, non-uniformly or non-periodically (as illustrated in FIG. 7) or non-randomly, periodically and uniformly as illustrated in FIG. 5. Thus, as illustrated in FIG. 5, the whetting pattern determinor 80 may cause the whetting areas or cells to be situated integrally with and adjacent to the pattern 50 corresponding to the image. This provides a line 112 of whetting areas, such as areas 66 and 68 in FIG. 5, which facilitate lubricating or cooling the doctor blade before it encounters and ink in the pattern 50 corresponding to the image. Notice that the whetting areas 66 and 68 shown in FIG. 5 are in fluid communication with the pattern 50.

If the decision at decision block 96 is negative or after the placement of the whetting areas at block 98, it is determined at decision block 100 whether all engraving/etching data for a job has been processed. If it has, then the routine is complete. Otherwise, it loops to block 102 where further engraving/etching data is obtained and processed beginning at block 92 as shown.

Figure 4:
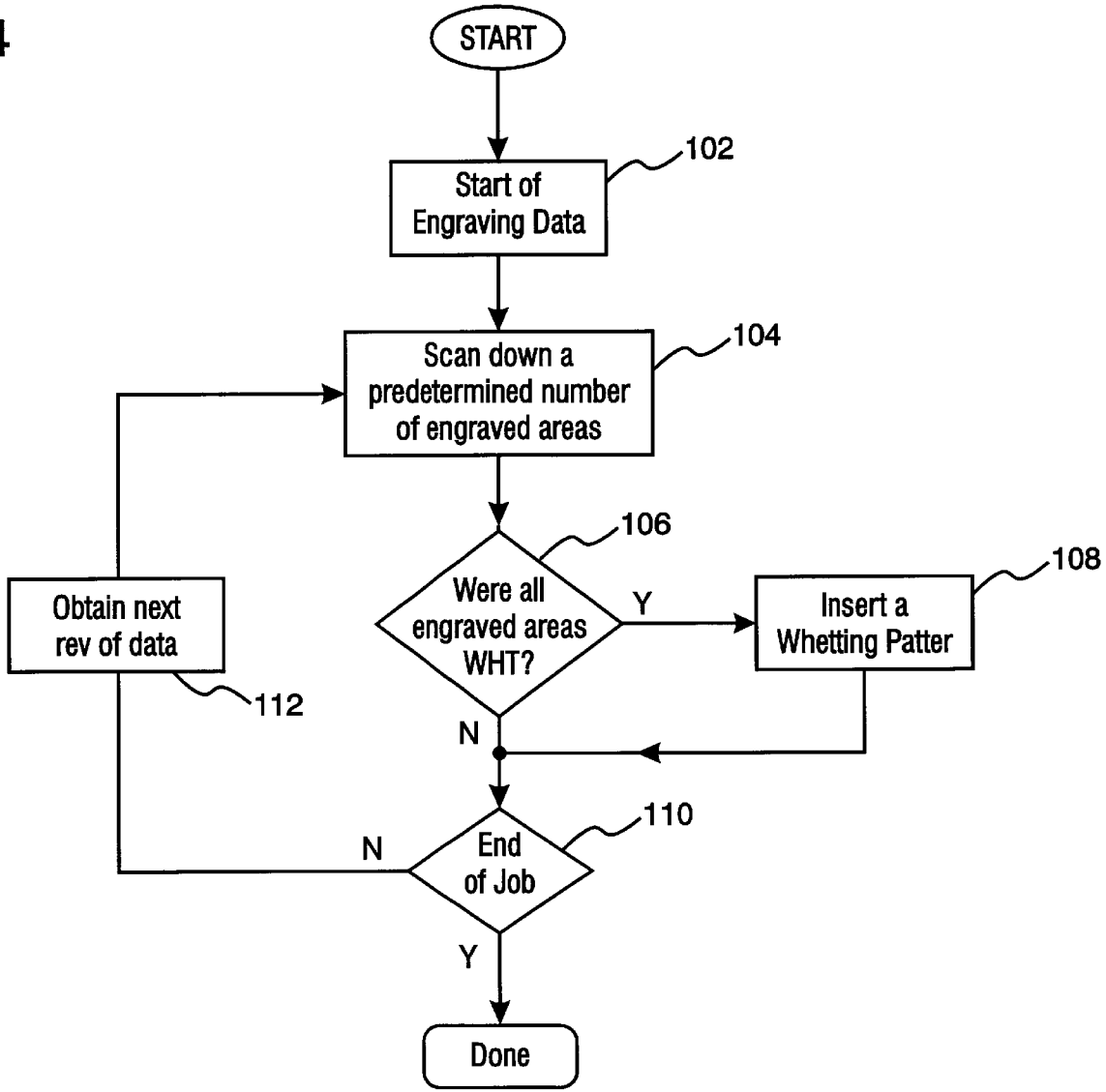
FIG. 4 is a schematic diagram of a periodic whetting pattern insertion routine in accordance with another embodiment of the invention.

FIG. 4 illustrates another, simplified, embodiment of the invention where periodic whetting areas or a pattern of whetting areas are automatically inserted in the engraving/etching data at predetermined intervals of a white-span length. In this embodiment, analyzer 80*a* of whetting pattern determinor 80 of computer 17 begins at the start of the engraving/etching data (block 102 in FIG. 4). At block 104, computer 17 scans the engraving/etching data for a predetermined number of areas. At decision block 106, it is determined whether all the areas which were scanned each had a video density value of zero percent, thereby indicating that each area was a "white" area. If it is, then the routine proceeds to block 108 where whetting pattern determinor 80 generates a whetting area or a pattern of whetting areas which signal generator 90 then uses to modify the job data to generate a signal in response thereto. Thereafter or if the decision at decision block 106 is negative, it is determined at decision block 110 whether the job is complete. If it is, then the routine is finished and all job data has been processed. If it is not, however, then the job data for the next revolution of cylinder 14 is obtained for analysis by whetting pattern determinor (block 112). Thereafter, the routine proceeds to block 104 as shown.

It should be appreciated that the predetermined dimension X referred to relative to FIGS. 3 and 8 or the number of areas selected relative to block 104 in FIG. 4 are defined by a user and, again, correlate to a threshold distance at which it is desired to begin cooling the doctor blade of the printing press before the blade encounters the ink received in the areas which make up the image pattern 50 (FIG. 2).

In the embodiment being described, the predetermined dimension X referred to in FIG. 3 corresponds to a length, such as the circumferential length X shown in FIG. 2, of at least 25 mm. Also, the whetting areas themselves are typically very small relative to the areas which make up the pattern 50. Moreover, the typical volume of an engraved or etched whetting area 66 or 68 is less than about 800 cubic microns.

Advantageously, this system and method provides convenient means for prelubricating and cooling a doctor blade in a printing press so that it does not vaporize or remove ink from the engraved or etched pattern corresponding to the image to be printed. This, in turn, provides improved cylinder engraving/etching which results in improved printing characteristics, especially at the edges of an image pattern where a doctor blade initially engages the ink in the engraved or etched pattern.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims. For example and as alluded to earlier herein, it is contemplated that features of the invention may be used in systems which are not restricted to mechanical engraving. Such systems include chemical etching, laser etching, laser engraving, electron beam engraving and the like.

What is claimed is:

1. A method for engraving/etching a plurality of whetting areas on a workpiece to facilitate lubricating and/or cooling a doctor blade when the workpiece is situated on a printing press, said method comprising the step of:

providing a system for engraving/etching said plurality of whetting areas at predetermined positions on the workpiece; said predetermined positions being determined in response to a job to be engraved or etched, said plurality of whetting areas being capable of holding ink for lubricating and/or cooling of said doctor blade when said workpiece is used in a printing press, said each of said plurality of whetting areas corresponding to an area capable of receiving ink which does not define a portion of said image when an image in said job is printed on a substrate.

2. The method as recited in claim 1 wherein said predetermined positions are determined in response to at least one of the following characteristics: copper hardness, cylinder rotational speed during printing, ink type, surface finish, roughness, substrate, blade type, or blade pressure.

3. The method as recited in claim 1 wherein said method further comprises the step of:

providing a system for engraving/etching a second plurality of areas corresponding to said image;

at least one of said plurality of whetting areas being in fluid communication with at least one of said second plurality of areas.

4. The method as recited in claim 1 wherein said method further comprises the step of:

providing a system for engraving/etching a second plurality of areas corresponding to said image;

wherein none of said plurality of whetting areas are in fluid communication with any of said second plurality of areas.

5. The method as recited in claim 1 wherein said method further comprises the step of:

determining a dimension of either a white-span area or an engraved or etched image area using said job data;

performing said engraving/etching step only if said dimension is greater than a predetermined dimension.

6. The method as recited in claim 5 wherein said method further comprises the step of:

determining said dimension of a white-span area, said predetermined dimension being a length greater than 25 millimeters.

7. The method as recited in claim 5 wherein said workpiece is a cylinder, said method further comprise the steps of:

calculating a dimension in at least one of either a circumferential direction or a linear direction;

performing engraving/etching of said plurality of whetting areas only if said dimension exceeds said predetermined dimension.

8. The method as recited in claim 7 wherein said dimension comprises a circumferential length of a white-span area.

9. The method as recited in claim 8 wherein said circumferential length is a length of image areas and said dimension is less than about 25 mm.

10. The method as recited in claim 7 wherein said dimension comprises a circumferential length of image areas.

11. The method as recited in claim 10 wherein said circumferential length is of a white-span area and said dimension is greater than about 25 mm.

12. The method as recited in claim 1 wherein each of said plurality of whetting areas are either less than about 20 microns in size or defines a volume of less than 800 cubic microns.

13. The system as recited in claim 1 wherein said whetting pattern comprises said whetting areas which are non-periodic, random or non-uniform.

14. The system as recited in claim 1 wherein each of said plurality whetting pattern is adjacent to an edge of an image pattern of areas.

15. The system as recited in claim 1 wherein said whetting pattern comprises said whetting areas which are uniformly or periodically spaced.

16. A method for locating a plurality of whetting areas on a workpiece to facilitate cooling and/or lubricating a doctor blade during a printing process;

providing a whetting pattern determinor for determining a whetting pattern defining said plurality of whetting areas which facilitate cooling and/or lubricating said doctor blade in response to a job to be engraved or etched; and providing a system for engraving/etching said whetting pattern and an image pattern corresponding to an image defined by said job.

17. The method as recited in claim 16 wherein each of said plurality of whetting areas are less than about 20 microns in size.

18. The method as recited in claim 16 wherein said method further comprises the step of:

providing a system for engraving/etching a second plurality of areas corresponding to said image;

at least one of said plurality of whetting areas being in fluid communication with at least one of said second plurality of areas.

19. The method as recited in claim 16 wherein said method further comprises the step of:

providing a system for engraving/etching a second plurality of areas defining said image pattern;

wherein none of said plurality of whetting areas are in fluid communication with any of said second plurality of areas.

20. The method as recited in claim 19 wherein each of said plurality of whetting areas is either less than about 20 microns in size or defines a volume of less than 800 cubic microns.

21. The method as recited in claim 16 wherein said method further comprises the step of:

examining data for said job and determining a dimension of a pattern of either a white-span area or black span areas on said workpiece;

engraving/etching said pattern only if said dimension is greater than a predetermined dimension.

22. The method as recited in claim 21 wherein said determining step further comprises the step of:

examining said job data and determining a dimension for a white-span area, said dimension being less than about 25 millimeters.

23. The method as recited in claim 21 wherein said method further comprises the steps of:

evaluating job data and determining a dimension of an image pattern, said predetermined dimension being at least 25 millimeters; and engraving said whetting pattern only if said dimension is greater than 25 millimeters.

24. The method as recited in claim 21 wherein said workpiece is a cylinder, said method further comprises the steps of:

calculating a dimension in a circumferential direction;

performing engraving/etching of said plurality of whetting areas only if said dimension exceeds said predetermined dimension.

25. The method as recited in claim 24 wherein said dimension comprises a circumferential length of a white-span area.

26. The method as recited in claim 25 wherein said length is at least 25 millimeters.

27. A system for locating a plurality of whetting areas for facilitating cooling and/or lubricating a doctor blade on an printing press, comprising:

a whetting pattern determinor for determining a whetting pattern in response to job data for a job to be engraved or etched, said whetting pattern determinor generating said whetting pattern of said plurality of whetting areas which facilitate cooling and/or lubricating said doctor blade.

28. The system as recited in claim 27 wherein said whetting pattern determinor comprises an analyzer for analyzing said data for said job and for generating said whetting pattern in response thereto.

29. The system as recited in claim 28 wherein said analyzer processes image data corresponding to an image in said job;

said analyzer generating said whetting pattern if a dimension of a pattern of either a white-span area or black span areas is greater than a predetermined dimension.

30. The system as recited in claim 29 wherein said workpiece comprises a cylinder, said analyzer further comprises:

a calculator for calculating a white-span dimension in at least one of a circumferential direction or axial direction;

said determinor generating said whetting pattern data corresponding to said whetting pattern if either said circumferential direction or axial direction exceeds a predetermined circumferential length or predetermined axial length, respectively.

31. The system as recited in claim 30 wherein either said predetermined circumferential length or said predetermined axial length is at least 25 millimeters.

32. The system as recited in claim 27 wherein said whetting pattern defines said whetting areas which are non-periodic, random or non-uniform.

33. The system as recited in claim 27 wherein at least one of said plurality of whetting areas is adjacent to an edge of an image pattern defined by said job.

34. The system as recited in claim 27 wherein said whetting pattern determinor generates said whetting pattern in response to at least one of the following features: copper hardness, cylinder rotational speed during printing, ink type, surface finish, roughness, substrate, blade type, or blade pressure.

35. The system as recited in claim 27 wherein said whetting pattern comprises a plurality of whetting areas which are randomly spaced.

36. An engraving system comprising:

a system for engraving a workpiece with a plurality of areas defining an image pattern;

a whetting pattern determinor for analyzing job data and for generating whetting data corresponding to a whetting pattern of areas in response thereto; and a signal generator for receiving job data, including image data corresponding to said image pattern, and said whetting data and for generating a signal in response thereto so that said whetting pattern is engraved relative to said engraved image pattern such that said whetting pattern facilitates cooling and/or lubricating a doctor blade in a printing press when said workpiece is used therein.

37. The engraving system as recited in claim 36 wherein said whetting pattern determinor comprises:

an analyzer for receiving job data and for generating said whetting pattern if a dimension of a white-span area or black span areas is greater than a predetermined dimension.

38. The engraving system as recited in claim 37 wherein said dimension comprises a dimension of a white-span area and said predetermined dimension is at least 25 millimeters.

39. The engraving system as recited in claim 36 wherein a length, a width, or a height of each of said plurality of whetting areas is less than about 20 microns.

40. The engraving system as recited in claim 36 wherein said workpiece comprises a cylinder, said whetting pattern determinor further comprises:

a calculator for calculating a white-span dimension in at least one of a circumferential direction or axial direction;

said determinor generating said whetting data if said white-span dimension exceeds a predetermined circumferential length or a predetermined axial length.

41. The system as recited in claim 40 wherein either said predetermined circumferential length or said predetermined axial length is at least 25 millimeters.

42. The system as recited in claim 36 wherein said whetting pattern determinor generates said whetting pattern in response to at least one of the following features: copper hardness, cylinder rotational speed during printing, ink type, surface finish, roughness, substrate, blade type, or blade pressure.

* * * * *